US012129852B2

(12) United States Patent
Sakunchit et al.

(10) Patent No.: US 12,129,852 B2
(45) Date of Patent: Oct. 29, 2024

(54) COMPRESSOR

(71) Applicant: SIAM COMPRESSOR INDUSTRY CO., LTD., Chonburi (TH)

(72) Inventors: Suriyan Sakunchit, Chonburi (TH); Somchai Durueangram, Chonburi (TH)

(73) Assignee: SIAM COMPRESSOR INDUSTRY CO., LTD., Chonburi (TH)

( * ) Notice: Subject to any disclaimer, the term of this patent is extended or adjusted under 35 U.S.C. 154(b) by 0 days.

(21) Appl. No.: 18/257,741

(22) PCT Filed: Jan. 4, 2021

(86) PCT No.: PCT/IB2021/050009
§ 371 (c)(1),
(2) Date: Jun. 15, 2023

(87) PCT Pub. No.: WO2022/144593
PCT Pub. Date: Jul. 7, 2022

(65) Prior Publication Data

US 2024/0052838 A1 Feb. 15, 2024

(51) Int. Cl.
*F04C 29/00* (2006.01)
*F04C 18/02* (2006.01)

(52) U.S. Cl.
CPC ..... *F04C 29/0042* (2013.01); *F04C 18/0215* (2013.01); *F04C 2240/60* (2013.01); *F04C 2240/80* (2013.01)

(58) Field of Classification Search
CPC ..... F04C 18/02–0292; F04C 2240/50; F04C 2240/60; F04C 2240/605; F04C 2240/80; F04C 29/0042; F04C 2230/603
See application file for complete search history.

(56) References Cited

U.S. PATENT DOCUMENTS

2009/0139262 A1* 6/2009 Takahashi ..... F04C 23/008 62/468

FOREIGN PATENT DOCUMENTS

JP 54121405 A * 9/1979

* cited by examiner

*Primary Examiner* — Mark A Laurenzi
*Assistant Examiner* — Xiaoting Hu
(74) *Attorney, Agent, or Firm* — Posz Law Group, PLC

(57) ABSTRACT

The present invention discloses a compressor comprising: a vessel; a crankshaft including an annular mounting recessed groove which is formed on its outer circumferential surface; a compression mechanism disposed over the crankshaft, and configured to compress the refrigerant sucked from an outside through rotation of the crankshaft; and a stopper which consists of a first stopper member and a second stopper member, and includes a through-hole which is formed between the first stopper member and the second member. The crankshaft is inserted into the through-hole of the stopper, and the stopper is engaged and fixed on the annular mounting recessed groove.

5 Claims, 5 Drawing Sheets

COMPRESSOR

CROSS REFERENCE TO RELATED APPLICATION

This application is a U.S. national stage application of PCT/IB2021/050009 filed on Jan. 4, 2021 the contents of which are incorporated herein by reference.

FIELD OF INVENTION

The present invention relates to a compressor.

BACKGROUND OF THE INVENTION

It is known that a compressor includes a main bearing which is interposed between a crankshaft and a housing and which receives a radial load acting in the radial direction of the crankshaft, and a thrust ball bearing having an inner ring and an outer ring that respectively have a recessed contact portion that receives the ball, as disclosed in Japanese Patent Application Laid-open No. H05-018384A1 hereinafter called PTL1.

In PTL1, the inner ring of the thrust ball bearing is brought into a non-contact state in the radial direction of the crankshaft and locked in the axial direction of the crankshaft. Further, the outer ring of the thrust ball bearing is locked to the housing.

However, in case that the compressor is mounted in a vehicle, a large force is applied to the crankshaft to displace the crankshaft in the up-and-down direction, while the vehicle is being driven. As such, there is a possibility that the crankshaft collides with the compression mechanism.

Therefore, the development of the compressor that prevent that the impact is applied to the compression mechanism by the crankshaft of the compressor that is mounted in the vehicle, while the vehicle is being driven, is required.

CITATION LIST

Patent Literature

PTL 1: Japanese Patent Application Laid-open No. H05-018384A1

SUMMARY OF THE INVENTION

It is an objective of the present inventions to provide a compressor that prevents that the impact is applied to the compression mechanism by the crankshaft of the compressor that is mounted in a vehicle, while the vehicle is being driven.

In order to achieve the above objective, an embodiment of the present invention provides a compressor comprising: a vessel; a crankshaft being accommodated in the vessel, which includes an annular mounting recessed groove which is formed on its outer circumferential surface; a compression mechanism, which is accommodated in the vessel, disposed over the crankshaft, and configured to compress the refrigerant sucked from an outside through rotation of the crankshaft; and a stopper which is a plate-like member including a first plane and a second plane, consists of a first stopper member and a second stopper member, and includes a through-hole which is formed between the first stopper member and the second member and penetrates from the first plane to the second plane. Moreover, the crankshaft is inserted into the through-hole of the stopper, and the stopper is engaged and fixed on the annular mounting recessed groove.

According to the embodiment of the present invention, firstly, since the stopper consists of two members (i.e. the first stopper member and the second stopper member), the stopper can be mounted around the crankshaft.

Secondly, since the crankshaft is inserted into the through-hole of the stopper as well as the stopper is engaged and fixed on the annular mounting recessed groove, it is possible to prevent the crankshaft from being displaced in the up-and-down direction even if the large force acting to displace the crankshaft in the up-and-down direction is applied to the crankshaft.

Therefore, it is possible to prevent that the impact is applied to the compression mechanism by the crankshaft of the compressor that is mounted in a vehicle, while the vehicle is being driven. As a result, each part of the compression mechanism can be operated at a predetermined position and the compression mechanism can efficiently compress the refrigerant.

BRIEF DESCRIPTION OF DRAWINGS

The principle of the present invention and its advantages will become apparent in the following description taking in consideration with the accompanying drawings in which:

FIG. 5 is an exploded perspective view of the crankshaft 36, a sub-frame 16, the stopper 40 and so on.

DETAILED DESCRIPTION OF EMBODIMENTS OF THE INVENTION

Figure 1:
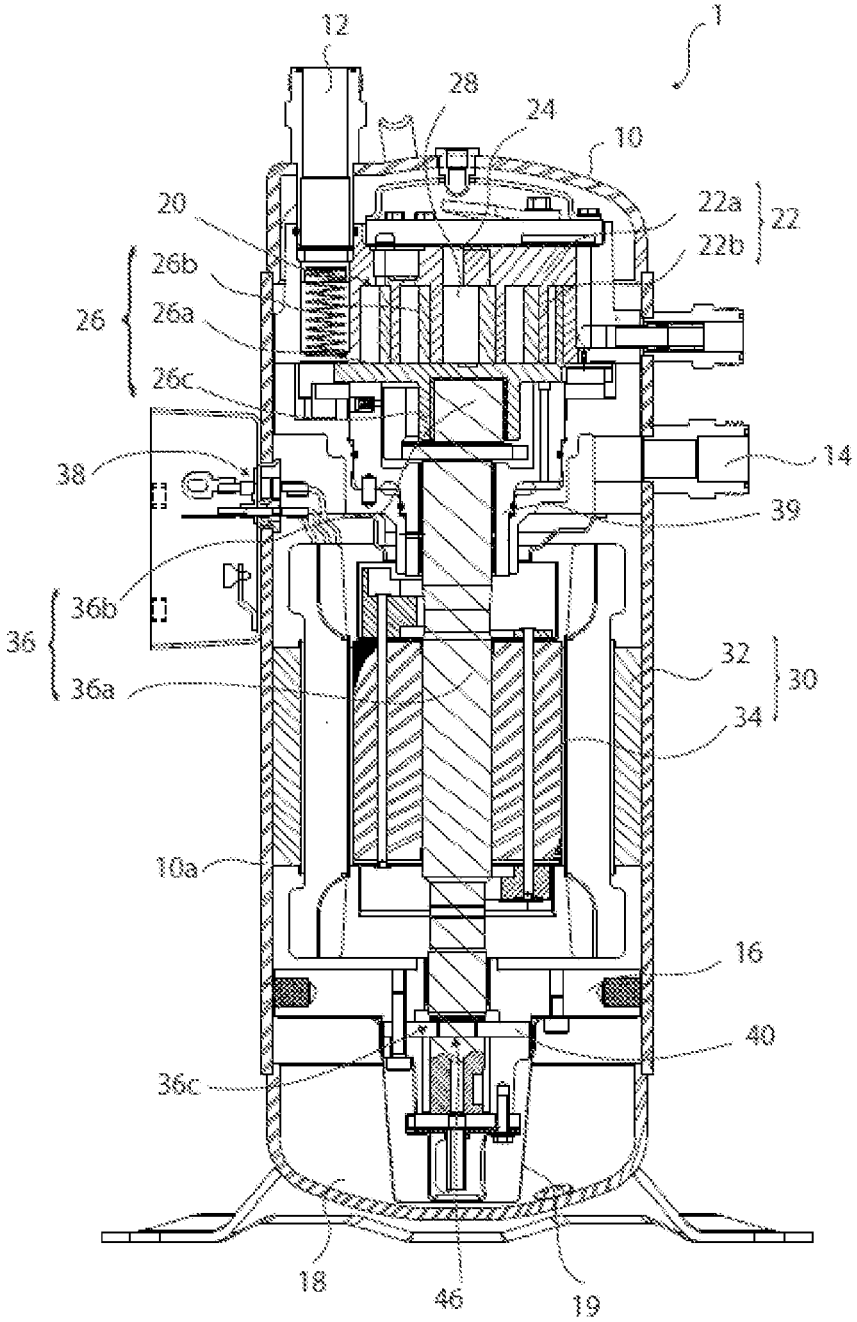
FIG. 1 is an explanation view illustrating a schematic configuration of a compressor 1 including a stopper 40 according to an embodiment of the present invention.

Hereinafter, an embodiment of the present invention will be described in detail with reference to the drawings. In the drawings, the same or corresponding parts are denoted by the same reference symbols, and description thereof is omitted or simplified as appropriate. Moreover, shapes, sizes, arrangements, and other factors of components illustrated in the drawings may be changed as appropriate without departing from the scope of the invention.

FIG. 1 is an explanation view illustrating a schematic configuration of a scroll compressor 1 according to the embodiment. The compressor 1 is a fluid machine configured to compress and discharge a fluid (e.g., gas refrigerant), and can be a component of a refrigeration cycle apparatus. The compressor 1 according to the embodiment is a vertically-mounted shell compressor 1, and installed into a vehicle.

As shown in FIG. 1, the compressor 1 includes a vessel 10 as a sealed container, a suction pipe 12 mounted penetratingly a top face of the vessel 10 and formed as a hollow cylindrical pipe, a discharge pipe 14 discharging the fluid to the outside, a scroll compression mechanism 20 configured to compress a fluid (low-pressure gas refrigerant) in a compression chamber 28, and a motor element 30 configured to drive the compression mechanism 20 are housed in the vessel 10.

The upper portion of the compression mechanism 20 is supported by a middle shell 10*a* of the vessel 10. The compression mechanism 20 is fixed to the middle shell 10*a* of the vessel 10 through shrink fit or other method. A sub-frame 16 is provided below the motor element 30. The sub-frame 16 is fixed to the inner circumferential surface of the vessel 10. An oil sump 18 is formed on a bottom of the vessel 10. A refrigerating machine oil lubricating sliding parts such as bearings is accumulated in the oil sump 18.

The suction pipe 12 configured to suck a fluid (low-pressure gas refrigerant) into the compression mechanism 20 from outside is connected to a top face of the vessel 10. The discharge pipe 14 configured to discharge the fluid (high-pressure gas refrigerant) to the outside of the compressor 1 is connected to a side face of the vessel 10.

The compression mechanism 20 is accommodated in the vessel 10 and configured to compress the refrigerant sucked from the suction pipe 12 through rotation of a crankshaft 36 that is rotated by the motor element 30. As shown in FIG. 1, the compression mechanism 20 includes a fixed scroll 22 and an orbiting scroll 26.

The fixed scroll 22 is fixed to the middle shell 10*a* at a lower end portion of the fixed scroll 22. The fixed scroll 22 includes a base plate 22*a* and a first scroll body 22*b* having an involute curve shape and erected on one surface of the base plate 22*a*. A discharge port 24 configured to discharge a compressed fluid is formed in a central part of the fixed scroll 22.

The orbiting scroll 26 is configured to orbit opposed to the fixed scroll 22 without rotating, by a non-illustrated Oldham mechanism. The orbiting scroll 26 includes a base plate 26*a* and a second scroll body 26*b* having an involute curve shape and erected on one surface of the base plate 26*a*. An orbiting bearing 26*c* formed in a bottomed cylindrical shape is formed in a substantially central part on an undersurface of the base plate 26*a*. An eccentric shaft portion 36*b* installed on an upper end of a main shaft portion 36*a* described later is inserted in the orbiting bearing 26*c*, in order to cause the orbiting scroll 26 to orbit.

The second scroll body 26*b* is configured to be engaged with the first scroll body 22*b* to form the compression chamber 28 between the first scroll body 22*b* and the second scroll body 26*b*. The orbiting scroll 26 is configured to orbit opposed to the fixed scroll 22.

The motor element 30 includes an electric motor stator 32 fixed to the inner circumferential surface of the vessel 10 through shrink fit or other method, an electric motor rotor 34 rotatably housed on an inner circumferential side of the electric motor stator 32, and the crankshaft 36 (main shaft portion 36*a*) fixed to the electric motor rotor 34 through shrink fit or other method. The electric motor stator 32 is connected to a glass terminal 38 via lead wires. The electric motor stator 32 is supplied with electric power from outside via the glass terminal 38 and lead wires. The electric motor rotor 34 is configured to rotate as electric power is supplied to the electric motor stator 32 and transmit a driving force to the orbiting scroll 26 through the crankshaft 36.

The eccentric shaft portion 36*b* located above the electric motor rotor 34 in the crankshaft 36 is rotatably supported in a radial direction by the cylindrical orbiting bearing 26*c* installed under the base plate 26*a*. The main shaft portion 36*a* is fitted in a main bearing 39 and slides along the main bearing 39 by an oil film of a lubricating oil. The eccentric shaft portion 36*b* eccentric to the main shaft portion 36*a* is installed on the upper end of the crankshaft 36.

A part of the crankshaft 36 located below the electric motor rotor 34 is rotatably supported by the sub-frame 16. An annular mounting recessed groove 36*c* is provided on the crankshaft 36 at a position below the height position corresponding to the sub-frame 16. The annular mounting recessed groove 36*c* is formed in an U-shape having a section opening to the middle shell 10*a* of the vessel 10 and includes a lower wall surface 36*cl* and an upper wall surface 36*c*2 in the depth direction of the annular mounting recessed groove 36*c*. The annular mounting recessed groove 36*c* is formed on an outer circumferential surface of the crankshaft 36.

A pump element 19 such as a positive displacement pump is installed at a lower end of the crankshaft 36. The pump element 19 supplies the refrigerating machine oil accumulated in the oil sump 18 to the sliding parts such as the main bearing 39. The pump element 19 is mounted on the sub-frame 16 and supports the crankshaft 36 in the axial direction on an upper end surface of the pump element 19.

An oil feed passage 36*d* (indicated with a broken line in FIG. 3) is formed in the crankshaft 36 in an axial direction thereof. During an operation of the compressor 1, a lubricating oil stored in the oil sump 18 of the vessel 10 is fed to the compression mechanism 20 through the oil feed passage so as to lubricate the compression mechanism 20.

Figure 3:
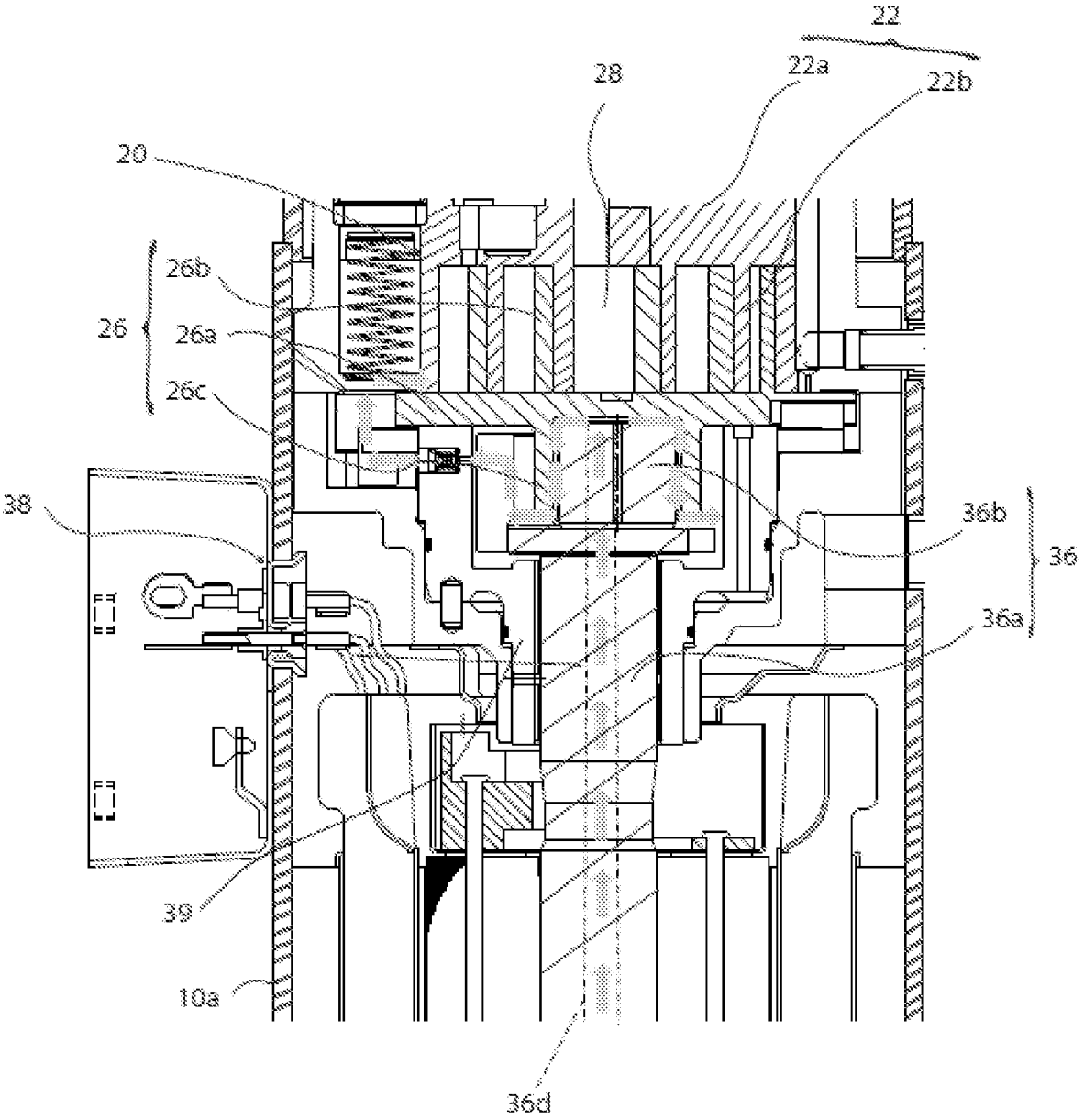
FIG. 3 is an explanation view of the position between a crankshaft 36 and a compression mechanism 20.

As shown by the arrows in FIG. 3, after the lubricating oil passes through the oil feed passage 36*d*, the lubricating oil is supplied to a clearance between the orbiting bearing 26*c* of the compression mechanism 20 and the eccentric shaft portion 36*b*. After that, the lubricating oil flows around the orbiting bearing 26*c*, and the lubricating oil is supplied to the compression mechanism 20 and the sliding parts such as the main bearing 39.

Figure 2:
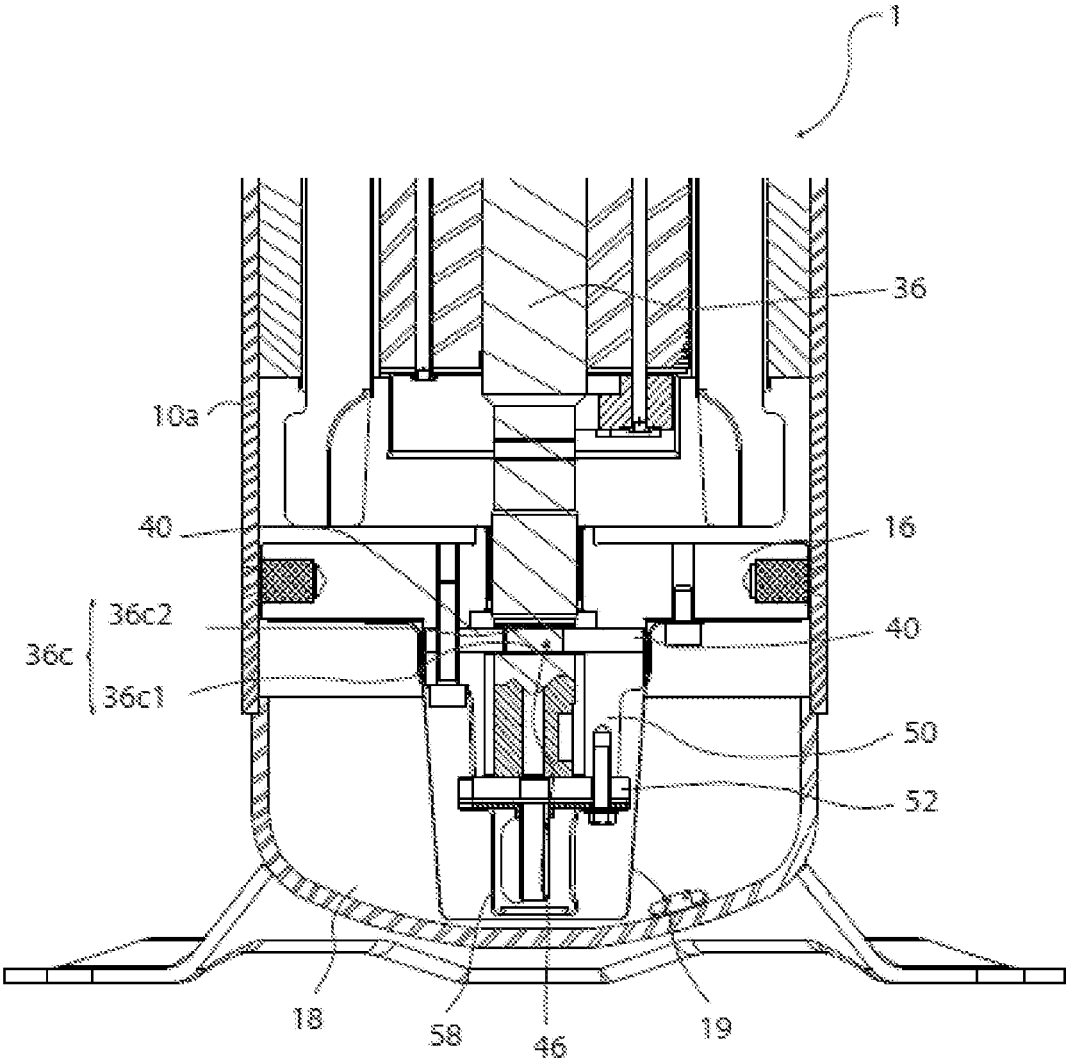
FIG. 2 is an enlarged view of a lower part of the compressor 1 in FIG. 1.

As shown in FIG. 1 and FIG. 2, a stopper 40 is mounted under the sub-frame 16 which is fixed to the inner circumferential surface of the vessel 10, so as to efficiently use the limited space inside the compressor 1. When the stopper 40 is mounted under the sub-frame 16, an inner edge part of the stopper 40 around a through-hole 46 is mounted so as to be sandwiched between the lower wall surface 36*c*1 and the upper wall surface 36*c*2.

Figure 4A:
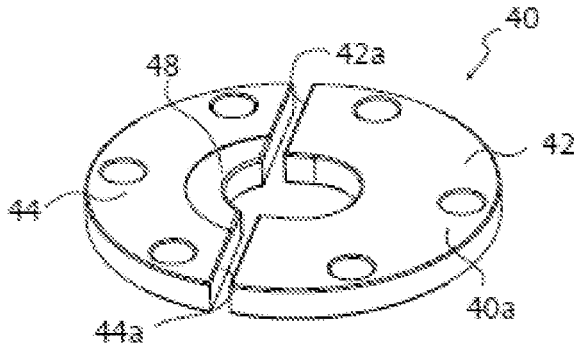
FIG. 4A is a perspective view when viewed from the bottom side of the stopper 40.
Figure 4B:
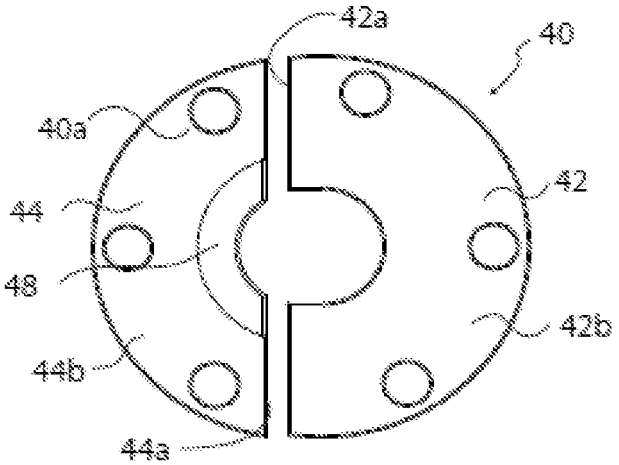
FIG. 4B is a perspective view when viewed from the upper side of the stopper 40.
Figure 4C:
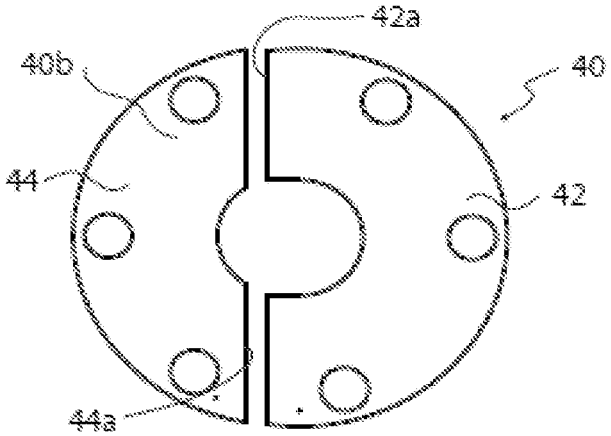
FIG. 4C is a bottom view of the stopper 40.

As shown in FIG. 4A, FIG. 4B and FIG. 4C, the stopper 40 is a plate-like member including a first plane 40*a* and a second plane 40*b*, consists of a first stopper member 42 and a second stopper member 44. Moreover, the stopper 40 includes the through-hole 46 which is formed between the first stopper member 42 and the second stopper member 44 and penetrates from the first plane 40*a* to the second plane 40*b*. Since the stopper 40 consists of two members (i.e. the first stopper member 42 and the second stopper member 44), the stopper 40 can be mounted around the crankshaft 36.

The first stopper member 42 and the second stopper member 44 include end faces 42*a*,44*a* formed to abut each other when the stopper 40 is mounted to surround the crankshaft 36, so that the abutting area between the stopper 40 and a wall surface of the annular mounting recessed groove 36*c* of the crankshaft 36 can be made larger.

When the stopper 40 is mounted to surround the crankshaft 36, the crankshaft 36 is inserted into the through-hole 46 of the stopper 40, and the stopper 40 is engaged and fixed on the annular mounting recessed groove 36*c*.

Moreover, an area of a bottom surface 42*b* of the first stopper member 42 is larger than that of a bottom surface 44*b* of the second stopper member 44. A recess portion 48 is formed around the through-hole 46 in the bottom surface

44*b* of the second stopper member 44. The recess portion 48 is the recess formed in an arc-shape when viewed from below of the second stopper member 44, and has a step-wise cross section.

A width of the recess portion 48 from the through-hole 46 in the radial direction is larger than a depth of the annular mounting recessed groove 36*c*.

Figure 5:
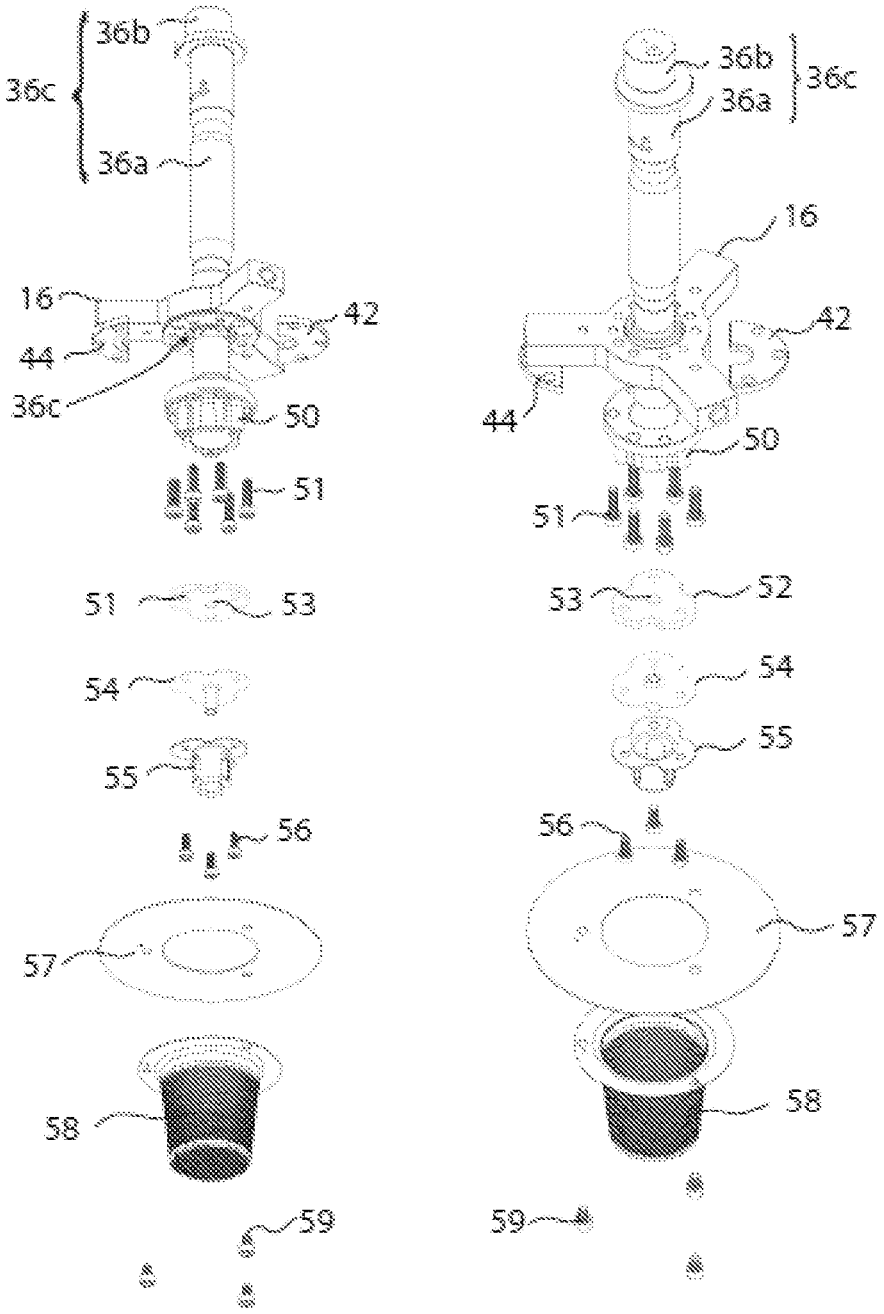

Next, a mounting structure of the stopper 40 is described in details with reference to FIG. 5. FIG. 5 is the exploded perspective view of the crankshaft 36, the sub-frame 16, the stopper 40 and so on.

As shown in FIG. 5, the sub-frame 16, the stopper 40, a thrust holder 50, a thrust plate 52, an oil pipe assembly 54, a shaft cover 55, a baffle plate 57, and a pump strainer assembly 58 are attached to the lower part of the crankshaft 36 in this order.

The thrust holder 50 is a cylindrical member into which the crankshaft 36 is inserted and for holding the crankshaft 36. The stopper 40 is pressed against the sub-frame 16 by the thrust holder 50 from below and fixed by the screws 51 which are the fastening members.

The thrust plate 52 is formed in a plate shape, and is in sliding contact with the crankshaft 36 to receive the thrust force of the crankshaft 36. A thrust plate opening 53 is formed in the center of the thrust plate 52 so that oil can be supplied to the oil feed passage 36*d* of the crankshaft 36.

The oil pipe assembly 54 and the shaft cover 55 are attached to the lower surface of the thrust plate 52 in this order. The oil pipe assembly 54 for supplying the oil to the thrust plate opening 53 is constituted by a plate member to make it easier to attach to the thrust plate 52 and a cylindrical oil pipe which penetrates the plate member. The shaft cover 55 is a cylindrical member formed so that the oil pipe assembly 54 can be inserted, as well as, the thrust plate 52, the oil pipe assembly 54 and the shaft cover 55 are attached to a bottom surface of the thrust holder 50 by screws 56 in this order.

The pump strainer assembly 58 is formed in a substantially cylindrical shape with a bottom, and formed by a metal mesh so that the oil accumulated in the oil sump 18 is sucked into the pump strainer assembly 58. The pump strainer assembly 58 is fixed to the sub-frame 16 together with the baffle plate 57 by screws 59. When the pump strainer assembly 58 is fixed to the sub-frame 16 together with the baffle plate 57, the thrust holder 50, the thrust plate 52, the oil pipe assembly 54 and the shaft cover 55 are accommodated in the pump strainer assembly 58.

Next, an operation of the stopper 40 is described in details with reference to FIG. 1 to FIG. 4.

(The Case that the Vehicle is Nor Driven)

Even if the compressor 1 is mounted in the vehicle, the large force is not applied to the crankshaft 36 to displace the crankshaft 36 in the up-and-down direction if the vehicle is not being driven. As such, the crankshaft 36 does not collide with the compression mechanism 20, as well as the fixed scroll 22 and the orbiting scroll 26 operate at the predetermined position in compression mechanism 20 respectively. As a result, the undesirable friction between the fixed scroll 22 and the orbiting scroll 26 is not generated and the compressor 1 is operated with desired efficiency.

(The Case that the Vehicle is Driven)

On the other hand, even if the compressor 1 is mounted in the vehicle, the large force is applied to the crankshaft 36 to displace the crankshaft 36 in the up-and-down direction if the vehicle is being driven.

The crankshaft 36 is inserted into the through-hole 46 of the stopper 40 as well as the stopper 40 is engaged and fixed on the annular mounting recessed groove 36*c*. As such, it is possible to prevent the crankshaft 36 from being displaced in the up-and-down direction even if the large force acting to displace the crankshaft 36 in the up-and-down direction is applied to the crankshaft 36.

Moreover, the area of the bottom surface 42*b* of the first stopper member 42 is larger than that of the bottom surface 44*b* of the second stopper member 44, as well as the recess portion 48 is formed around the through-hole 46 in the bottom surface 44*b* of the second stopper member 44.

In case the first stopper member 42 is mounted on a position not higher than the second stopper member 44, the lower wall surface 36*c*1 of the annular mounting recessed groove 36*c* contacts with the bottom surface 42*b* of the first stopper member 42.

On the other hand, in case that the first stopper member 42 is mounted on a position higher than the second stopper member 44, since the recess portion 48 is formed around the through-hole 46 in the bottom surface 44*b* of the second stopper member 44, the lower wall surface 36*c*1 of the annular mounting recessed groove 36*c* can move upwardly until the lower wall surface 36*c*1 of the annular mounting recessed groove 36*c* contacts with the bottom surface 42*b* of the first stopper member 42.

As such, it is possible to surely prevent the crankshaft 36 from being displaced in the up-and-down direction even if the large force acting to displace the crankshaft 36 in the up-and-down direction is applied to the crankshaft 36, as well as to surely prevent that the impact is applied to the compression mechanism 20 by the crankshaft 36 of the compressor 1.

Furthermore, the first stopper member 42 and the second stopper member 44 include end faces 42*a*,44*a* formed to abut each other when the stopper 40 is mounted to surround the crankshaft 36. As such, the abutting area between the stopper 40 and the lower wall surface 36*c*1 of the annular mounting recessed groove 36*c* of the crankshaft 36 can be increased. As a result, it is possible to more surely prevent that the impact is applied to the compression mechanism 20 by the crankshaft 36 of the compressor 1.

Therefore, it is possible to prevent that the impact is applied to the compression mechanism 20 by the crankshaft 36 of the compressor 1 that is mounted in a vehicle, while the vehicle is being driven. As a result, each part of the compression mechanism 20 can be operated at a predetermined position and the compression mechanism 20 can efficiently compress the refrigerant.

Additionally, the clearance between the orbiting bearing 26*c* of the compression mechanism 20 and the eccentric shaft portion 36*b* can be kept at the predetermined distance. As a result, the undesirable friction between the fixed scroll 22 and the orbiting scroll 26 is not generated as well as the compressor 1 is operated with desired efficiency, even if the vehicle is not being driven.

Although specific embodiments of the invention have been disclosed and described as well as illustrated in the companying drawings, it is simply for the purpose of better understanding of the principle of the present invention and it is not as a limitation of the scope and spirit of the teaching of the present invention. Adaption and modification to various structures such as design or material of the invention, mounting mechanism of various parts and elements or embodiments are possible and apparent to a skilled person without departing from the scope of the present invention which is to be determined by the claims.

LIST OF REFERENCE

1: compressor
10: vessel
10*a*: middle shell
12: suction pipe
14: discharge pipe
16: sub-frame
18: oil sump
19: pump element
20: compression mechanism
22: fixed scroll
22*a*: base plate
22*b*: first scroll body
24: discharge port
26: orbiting scroll
26*a*: base plate
26*b*: second scroll body
26*c*: orbiting bearing
28: compression chamber
30: motor element
32: electric motor stator
34: electric motor rotor
36: crankshaft
36*a*: main shaft portion
36*b*: eccentric shaft portion
36*c*: annular mounting recessed groove
36*c*1: lower wall surface
36*c*2: upper wall surface
36*d*: oil feed passage
38: glass terminal
39: main bearing
40: stopper
40*a*: first plane
40*b*: second plane
42: first stopper member
42*a*: end face
42*b*: bottom surface
44: second stopper member
44*a*: end face
44*b*: bottom surface
46: through-hole
48: recess portion
50: thrust holder
51: screw
52: thrust plate
53: thrust plate opening
54: oil pipe assembly
55: shaft cover
56: screw
57: baffle plate
58: pump strainer assembly
59: screw

The invention claimed is:

1. A scroll compressor comprising:

a vessel;

a crankshaft being accommodated in the vessel, which includes a main shaft portion, an eccentric shaft portion installed on an end of the main shaft portion, and an annular mounting recessed groove which is formed on an outer circumferential surface of the crankshaft;

a compression mechanism, which includes a fixed scroll and an orbiting scroll, and which is accommodated in the vessel, disposed over the crankshaft, and configured to compress the refrigerant sucked from an outside through rotation of the crankshaft; and a stopper which is a plate-shaped member including a first plane and a second plane, consists of a first stopper member and a second stopper member, and includes a through-hole which is formed between the first stopper member and the second stopper member and penetrates from the first plane to the second plane;

wherein the orbiting scroll includes a base plate, a scroll body, and an orbiting bearing formed in a bottomed cylindrical shape, and the orbiting bearing is formed in a substantially central part on an undersurface of the base plate;

wherein the eccentric shaft portion is inserted in the orbiting bearing;

wherein the crankshaft is inserted into the through-hole of the stopper, and the stopper is engaged and fixed on the annular mounting recessed groove; and wherein a recess portion is formed around the through-hole in a bottom surface of the second stopper member.

2. The scroll compressor of claim 1, wherein an area of a bottom surface of the first stopper member is larger than that of the bottom surface of the second stopper member.

3. The scroll compressor of claim 1, wherein the stopper is mounted under a sub-frame which is fixed to the inner circumferential surface of the vessel.

4. The scroll compressor of claim 1, wherein the first stopper member and the second stopper member include end faces formed to abut each other when the stopper is mounted to surround the crankshaft.

5. The scroll compressor of claim 1, wherein a width of the recess portion from the through hole in the radial direction is larger than a depth of the annular mounting recessed groove.

* * * * *